US006142827A

United States Patent [19]

Lin

[11] Patent Number: 6,142,827

[45] Date of Patent: Nov. 7, 2000

[54] CONNECTOR CASING WITH FLUID PLASTICS BAFFLE

[75] Inventor: Chao-Tsung Lin, Taipei, Taiwan

[73] Assignee: Advanced Connectek Inc., Taipei, Taiwan

[21] Appl. No.: 09/018,840

[22] Filed: Feb. 4, 1998

[51] Int. Cl.[7] ..... H01R 9/03

[52] U.S. Cl. ..... 439/610; 439/901

[58] Field of Search ..... 439/610, 405, 439/456, 460, 604, 605, 606, 607, 608, 609, 705, 901, 904, 906

[56] References Cited

U.S. PATENT DOCUMENTS

| | | | |
|---|---|---|---|
| 4,449,778 | 5/1984 | Lane | 339/143 R |
| 4,582,384 | 4/1986 | Frantz et al. | 339/143 R |
| 4,981,447 | 1/1991 | Ichitsubo | 439/607 |
| 5,425,657 | 6/1995 | Davis et al. | 439/610 |

*Primary Examiner*—Lincoln Donovan
*Attorney, Agent, or Firm*—Dougherty & Troxell

[57] ABSTRACT

A connector casing with fluid a plastics baffle including a terminal case and a cable extending into the terminal case. The terminal case is formed from a top and a base closed to each other by fasteners provided on their side walls. The terminal case defines an inner space for containing a terminal holder which firmly holds the end of the cable extended into the terminal case. A cable holder projects from the base of the terminal case to hold the cable in place. A baffle having an opening is provided on the top corresponding to the cable holder, such that when the baffle is downward folded to a vertical position, its two ends fittingly contact with two side walls of the terminal case and its opening straddles an outer periphery of the cable extending into the terminal case via the opening, leaving no gap for any fluid plastics for forming an insulating cover of the connector to enter into the terminal case and damage the terminal holder.

5 Claims, 12 Drawing Sheets

CONNECTOR CASING WITH FLUID PLASTICS BAFFLE

FIELD OF THE INVENTION

The present invention relates to a connector casing with fluid plastics baffle, and more particularly to a connector casing which is provided at a cable end with a downward folded baffle to prevent fluid plastics for forming insulating coating of the connector from entering into the casing so as to improve the quality of the connector.

DESCRIPTION OF THE PRIOR ART

The highly developed computer and communication technologies allow people to obtain various information in a more convenient manner. Connectors are electronic components most frequently used in computer and communication equipment. Connectors facilitate not only quick and flexible connection of various internal and external expansion structures to the electronic equipment, but also communication with a remote place. In brief, connectors are significantly important in terms of the transmission of electric signals via them.

Among various kinds of connectors, there is a universal serial bus (USB) connector. FIGS. 1A and 1B illustrate conventional Type A and Type B USB connectors, respectively. Type A and Type B USB connectors have generally similar structure, and mainly include a cable 10, a terminal case 20, and an insulating cover 30. The cable 10 extends into the terminal case 20 from one end thereof and is connected to a terminal holder (not shown) fixedly mounted in the terminal case 20. The terminal case 20 includes a top 21 and a base 22. Both the top 21 and the base 22 are formed from integral pieces of material by punching and folding the material into desired shapes. An end of the top 21 from where the cable 10 extends into the case 20 has a forward projected extension which forms a cable holder 23 for holding the cable 10 in place. Fastening means 24, such as convex retainers and concave catchers, are provided on the top 21 and the base 22 at their corresponding side walls, such that the top 21 may be closed to the base 22 to define an inner space between them for accommodating the cable 10 and the terminal holder connected to an end of the cable 10. After the cable 10, the terminal holder, and the terminal case 20 are assembled, the terminal case 20 is coated with thermosetting plastics to form an insulating cover 30.

Following are drawbacks found in the above-described connector casing structure:

1. An opening 25 is left on the terminal case 20 between the top 21 and the base 22 corresponding to the forward projected cable holder 23. To prevent fluid thermosetting plastics from entering into the terminal case 20 via the opening 25 during the forming of the insulating cover 30 and therefore destroying the terminal connection in the terminal case 20, a bevel plate 26 is usually integrally provided along with the top 21 near the cable holder 23, so that the bevel plate 26 may be downward folded to cover the opening 25. However, since the bevel plate 26 and the cable holder 23 are integral parts of the material forming the top 21, and since the bevel plate 23 and the cable holder 23 contain angles between them when the material forming the top 21 is in an unfolded state, the bevel plate 26 is inevitably formed with cuts. The cuts prevent the downward folded bevel plate 26 from completely sealing the opening 25. That is, the bevel plate 26 fails to completely stop the fluid plastics from entering into the terminal case 20 via the cable end thereof, resulting in unstable connector quality.

2. To compensate the above-mentioned structural disadvantage of not able to completely stop fluid plastics from entering the terminal case 20, attempt has been made to provide the terminal holder and other elements in the terminal case 20 with means to protect terminal pins from damage by plastics flowing into the terminal case 20. However, since holes on the terminal holder for connecting conductors contained in the cable 10 are very small, it is extremely difficult to design and provide protective means on the terminal holder and other elements in the terminal case 20.

It is therefore tried by the inventor to develop the present invention to eliminate drawbacks found in the conventional connector casing.

SUMMARY OF THE INVENTION

A primary object of the present invention is to provide a connector casing with a fluid plastics baffle, wherein the connector casing mainly includes a terminal case and a cable extending one end into the terminal case. The terminal case is formed from a top and a base closed to each other by fastening means provided on their side walls. The terminal case defines an inner space for containing a terminal holder which firmly holds the end of the cable extended into the terminal case. A cable holder forward projects from the base of the terminal case to hold the cable in place. A baffle having an opening is provided on the top corresponding to the cable holder, such that when the baffle is downward folded to a vertical position, its two ends fittingly contact two side walls of the terminal case and its opening fittingly straddles an outer periphery of the cable extending into the terminal case via the opening, leaving no gap for any fluid plastics for forming an insulating cover of the connector to enter into the terminal case and damage the terminal holder.

Another object of the present invention is to provide a connector casing with a fluid plastics baffle to effectively prevent fluid plastics from entering into the connector, so that the design of connector can be simplified.

BRIEF DESCRIPTION OF THE DRAWINGS

The detailed structure and functions of the present invention and the principles applied to effect such structure and functions can be best understood by referring to the following detailed description of the preferred embodiments and the accompanying drawings, wherein.

DETAILED DESCRIPTION OF THE PREFERRED EMBODIMENTS

The present invention relates to a connector casing with fluid plastics baffle. The connector casing mainly includes a terminal case coated with a layer of insulting plastics and a cable extending one end into the terminal case. A downward folded baffle is vertically provided at a cable end of the terminal case to prevent fluid plastics for forming the insulating layer of the terminal case from entering into the case. The baffle also functions to hold the cable in place.

Figure 1A:
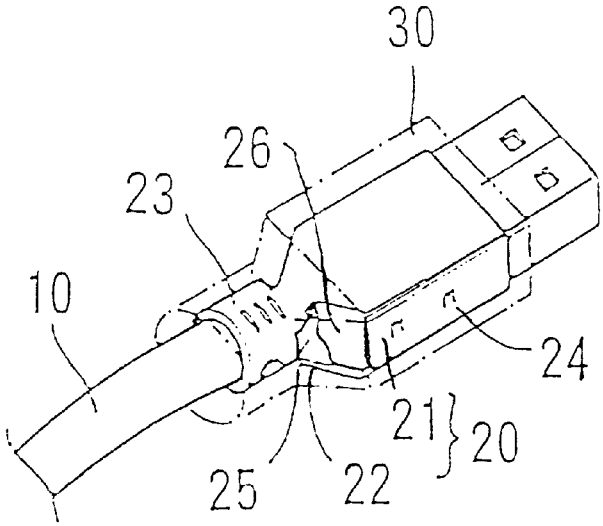
Fig. 1A (Prior Art)
FIG. 1A is a perspective view of a conventional connector casing.
Figure 1B:
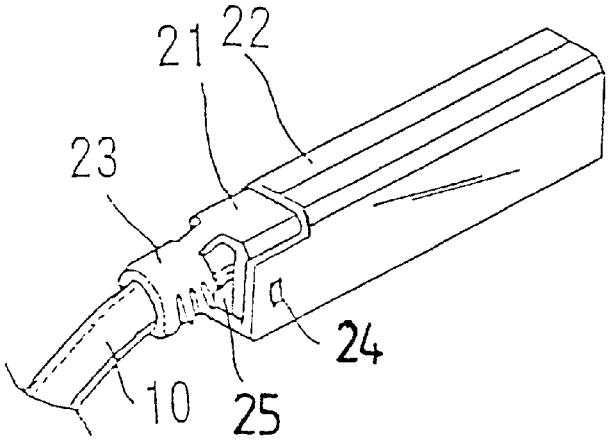
Fig. 1B (Prior Art)
FIG. 1B is a perspective view of another conventional connector casing.
Figure 2:
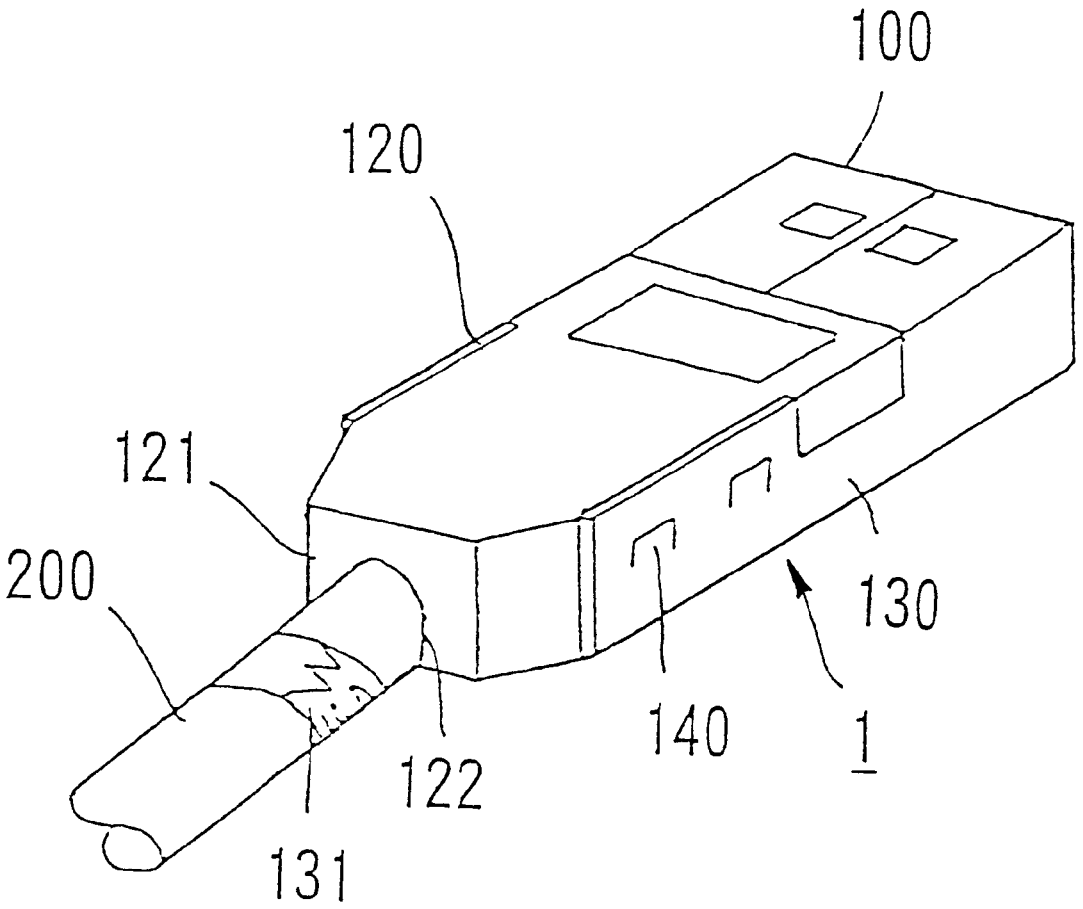
FIG. 2 is a perspective view of a connector casing according to a first embodiment of the present invention.

FIG. 2 illustrates a Type A universal serial bus (USB) connector 1 adopting the connector casing according to a first embodiment of the present invention. The connector 1 includes a terminal case 100 in which a terminal holder (not shown) is mounted, and a cable 200 extending one end into the terminal case 100 via a cable end thereof. The terminal case 100 includes a top 120 and a base 130 both formed from integral pieces of material by punching, stanping and folding the material into desired shapes. A cable end of the base 130 from where the cable 200 extends into the terminal case 100 has a forward projected extension which forms a cable holder131 for holding the cable 200 inplace. Fastening means 140, such as convex retainers and concave catchers, are provided on the top 120 and the base 130 at their corresponding side walls, such that the top 120 may be closed to the base 130 to define an inner space between them for accommodating the cable 200 and the terminal holder connected to inner end of the cable 200. The top 120 is provided at a cable end with a baffle 121 corresponding to the cable holder 131. The baffle 121 is an integral part of the top 120 and is provided at a position corresponding to the cable 200 with an opening 122 having a shape substantially similar to an outer peripheral shape of the cable 200. The baffle 121 is in a downward folded state when the top 120 of the terminal case 100 is formed and an inner edge of the opening 122 fittingly contacts the outer peripheral surface of the cable 200, making the cable end of the top 120 and the base 130, and accordingly, the terminal case 100, completely sealed by the baffle 121. Whereby, when the cable 200, the terminal holder (not shown), and the terminal case 100 have been assembled to form a connector casing and fluid plastics is applied over the terminal case to form an insulating layer, the baffle 121 effectively stops the fluid plastics from entering into the terminal case 100 via the cable end.

Figure 3B:
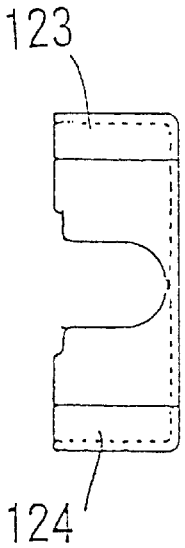
"FIG. 3B is an end view of the connector casing of FIG. 2;"
Figure 3A:
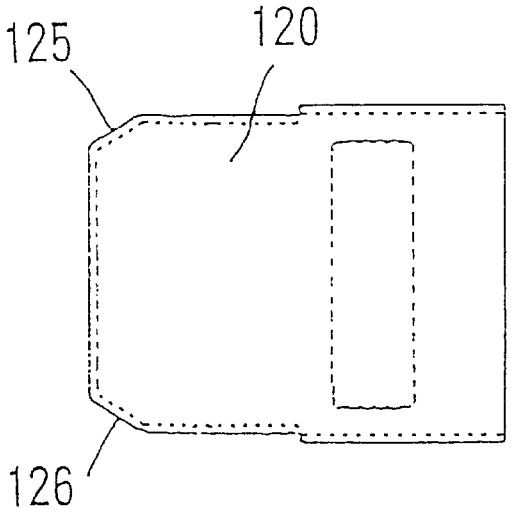
FIG. 3A is a top view of the connector casing of FIG. 2.
Figure 4:
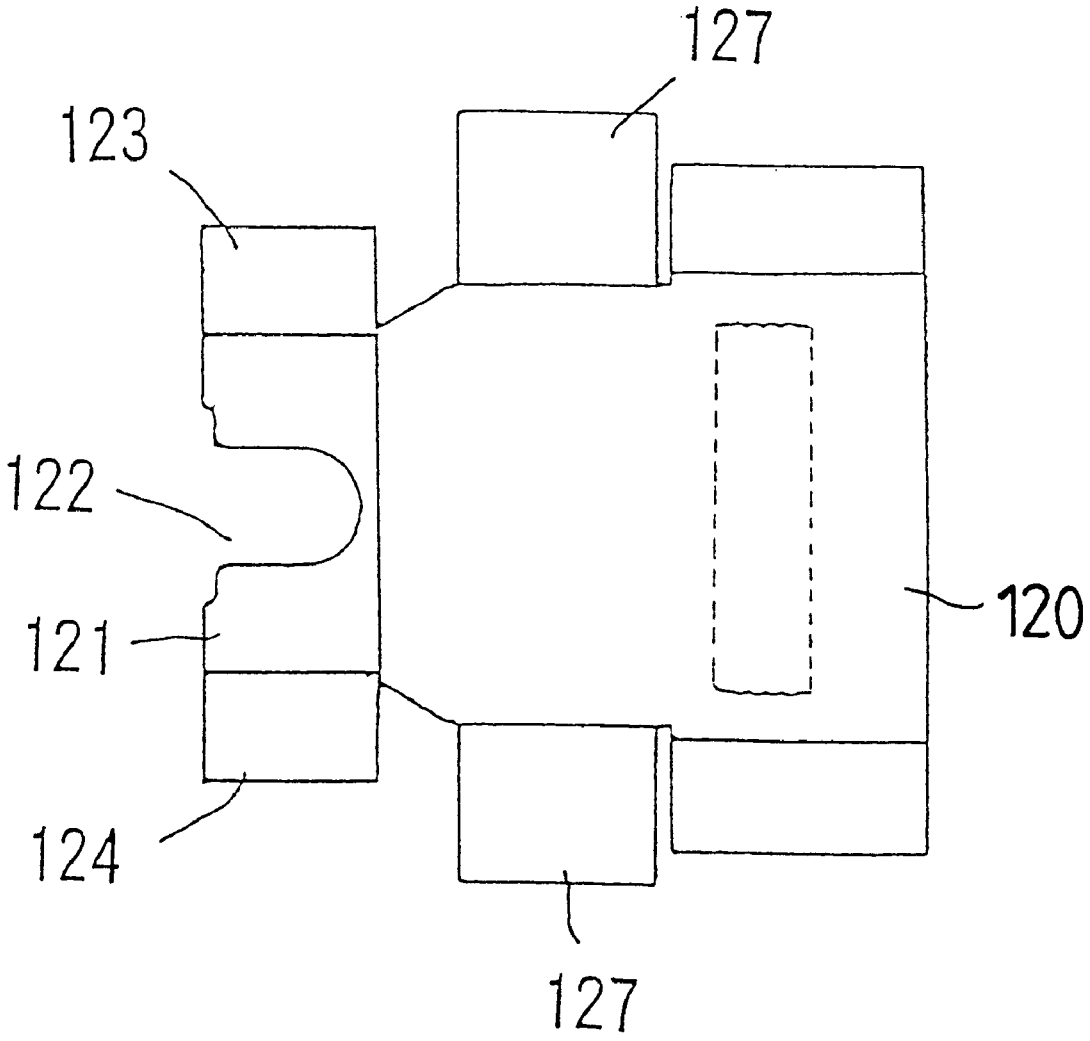
FIG. 4 shows the top of the connector casing of FIG. 2 in a fully unfolded state.

FIG. 3A and 3B illustrate the forming of a top 120 of Type A USB connector 1 of FIG. 2, and FIG. 4 is a plan view showing the top 120 of FIG. 2 in an unfolded state. As shown, the baffle 121 at a front end of the top 120 is provided with not only an opening 122 but also foldable side panels 123 and 124. When the baffle 121 is downward folded to a vertical position, the side panels 123, 124 may be folded backward at the same time to cover openings at edges 125 and 126 at two front bevels of the top 120. Two flaps 127 at two sides of the top 120mayalsobe folded downward to form two side walls of the top 120. When the top 120 is formed through the above folding steps, the vertical baffle 121 shall straddle the cable 200 with the opening 122 fittingly contacting with the outer periphery of the cable 200, so that the cable end of the top 120 is completely closed by the baffle 121.

Figure 5:
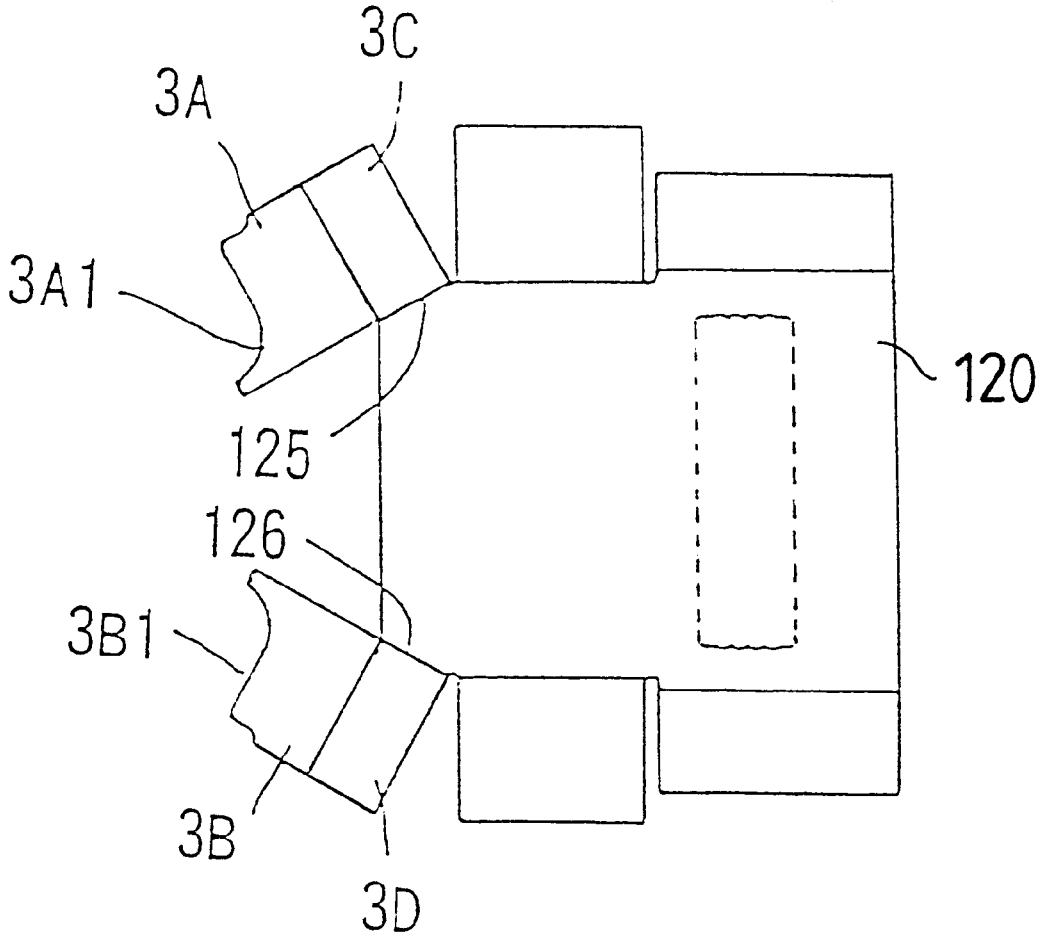
FIG. 5 shows another embodiment the top of FIG. 4 in an unfolded state.

Please refer to FIG. 5 which shows another embodiment of the top 120 for the connector 1 of FIG. 2. In this embodiment, the top 120 has a baffle 121 consisting of a left baffle 3A and a right baffle 3B separately extending from edges 125 and 126 of front left and front right bevels of the top 120. Portions on the left and right baffles 3A, 3B adjacent to edges 125, 126 are defined as left side panel 3C and right side panel 3D. A left half arch opening 3A1 and a right half arch opening 3B1 are formed on the left baffle 3A and the right baffle 3B, respectively, opposite to the left side panel 3C and the right side panel 3D. When the left and the right baffles 3A, 3B are folded toward one another about predetermined folding lines, the half arch openings 3A1, 3B1 together form an opening which fittingly contacts with outer periphery of the cable 200 extending therethrough and thereby completely closes the cable end of the top 120.

Figure 6:
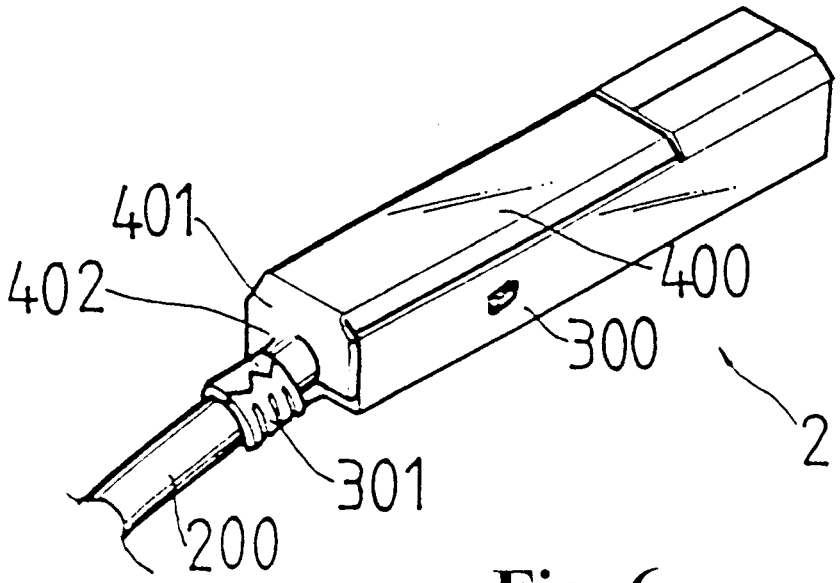
FIG. 6 is a perspective view showing a connector casing according to a second embodiment of the present invention.
Figure 7:
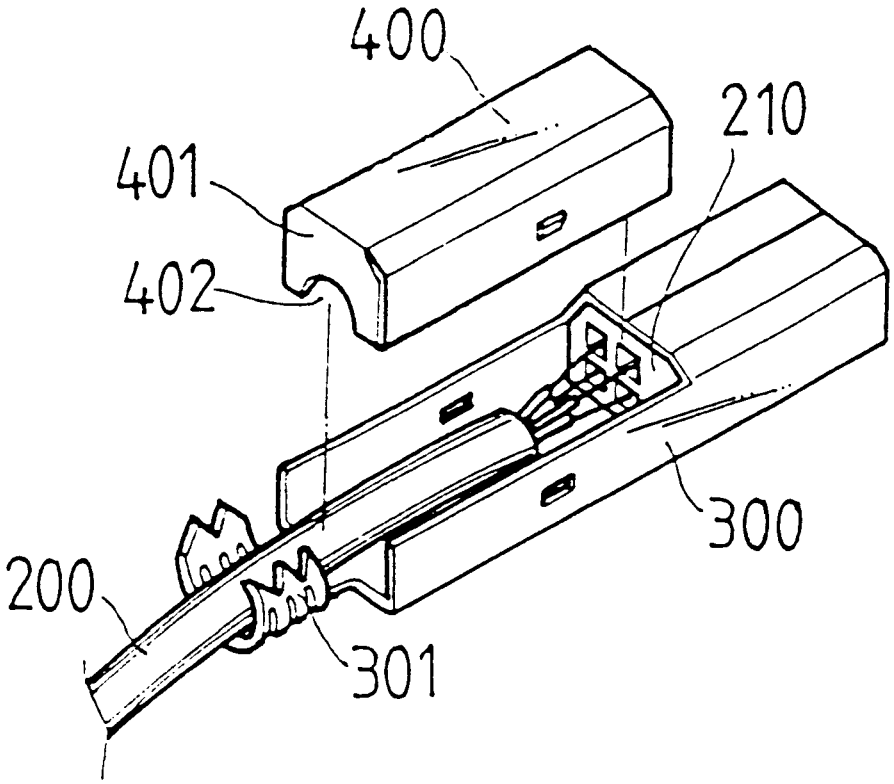
FIG. 7 is a partially exploded perspective of the connector casing of FIG. 6.

FIG. 6 illustrates a Type B universal serial bus (USB) connector 2 adopting the connector casing according to a second embodiment of the present invention and FIG. 7 is a partially exploded perspective of FIG. 6. As shown in the figures, the connector 2 includes a base 300 having a cable holder 301 forward projecting from a cable end of the base 300, and a top 400 having a baffle 401 provided at the cable end corresponding to the cable holder 301 of the base 300. An area on the baffle 401 from where the cable 200 extends into the connector 2 is cut out to form an opening 402 having a shape substantially similar to an outer periphery of the cable 200. Whereby, when the baffle 401 is folded to a vertical position, the opening 402 shall fittingly contact its inner edge with the cable 200 and two lateral ends of the baffle 401 shall fittingly contact with edges of two side walls of the base 300. To assemble the connector 2, as shown in FIG. 7, first mount a terminal holder 210 into the base 300, close the top 400 to the base 300 with the opening 402 on the baffle 401 firstly contacting with outer periphery of the cable 200 and holding the cable 200 in place. The cable end of the connector 2 is therefore completely sealed by the baffle 401.

Figure 8:
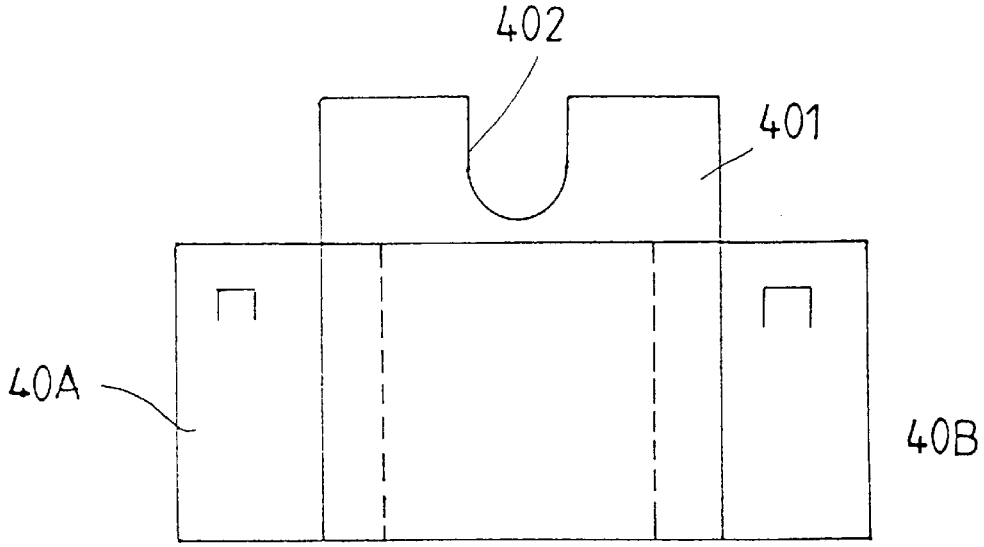
FIG. 8 shows the top of the connector casing of FIG. 6 in an unfolded state.

FIG. 8 is an unfolded plan view of the top 400 for the connector 2 of FIG. 6. As shown, a free end of the baffle 401 is formed with an opening 402. When the baffle 401 is downward folded, the opening 402 shall directly straddle the outer periphery of the cable 200. Two side panels 40A, 40B of the top 400 may also be downward folded to contact the base 300.

Figure 9:
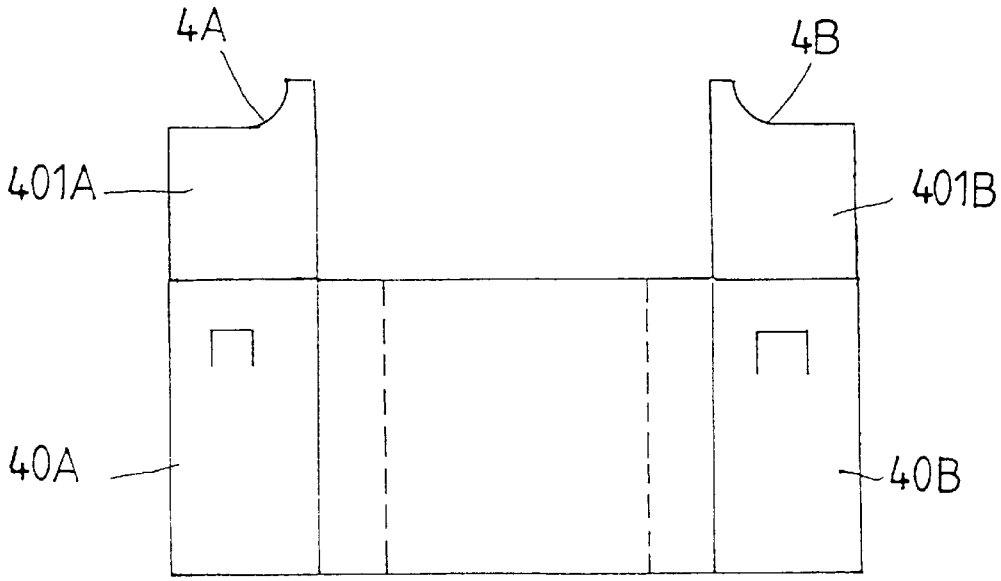
FIG. 9 shows another embodiment of the top of FIG. 8 in an unfolded state.

FIG. 9 illustrates an unfolded plan view of another embodiment of the top 400 for the connector 2. In this embodiment, the top 400 has a baffle 401 consisting of a left baffle 401A and a right baffle 401B separately forward extending from a left side panel 40A and right side panel 40B of the top 400. A left half arch opening 4A and a right half arch opening 4B are formed on the left baffle 401A and the right baffle 401B, respectively, opposite to the left side panel 40A and the right side panel 40B. When the left and the right side panels 40A, 40B are downward folded to a vertical position, and the left and the right baffles 401A, 401B are folded toward one another about predetermined folding lines, the half arch openings 4A, 4B together form an opening which fittingly contacts the outer periphery of the cable 200 extending therethrough and thereby completely closes the cable end of the top 400.

Figure 10:
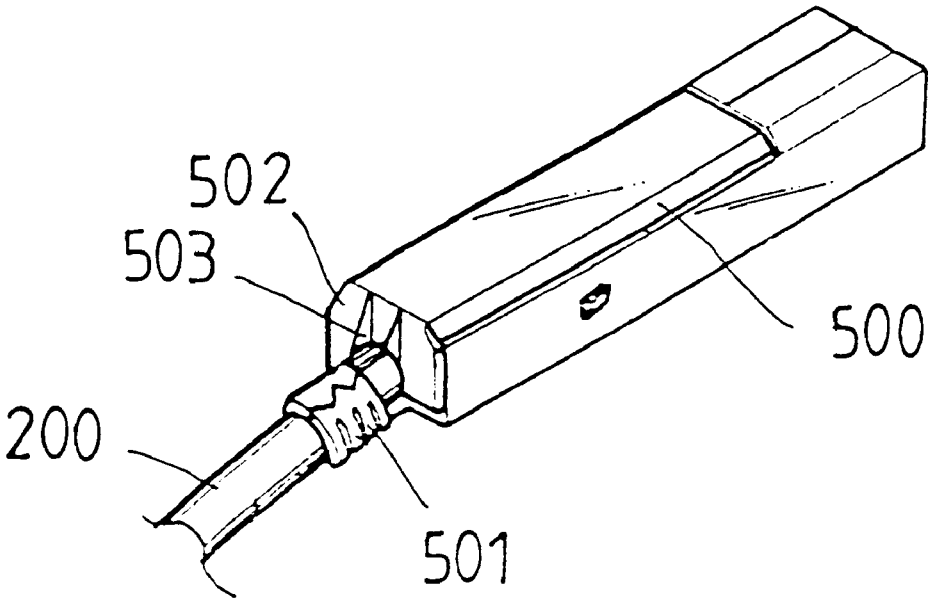
FIG. 10 is a perspective view showing another embodiment of the connector casing of FIG. 6.
Figure 15:
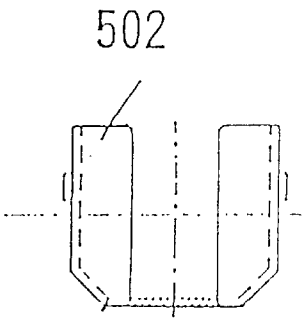
Figure 11A:
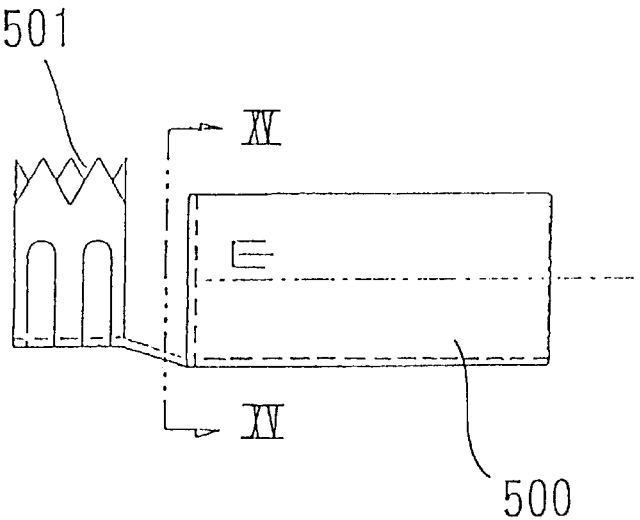
FIG. 11A and 11B are side and front views of the connector casing of FIG. 10.
Figure 11B:
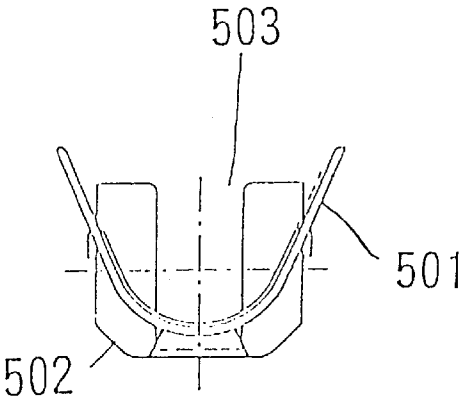
Figure 12:
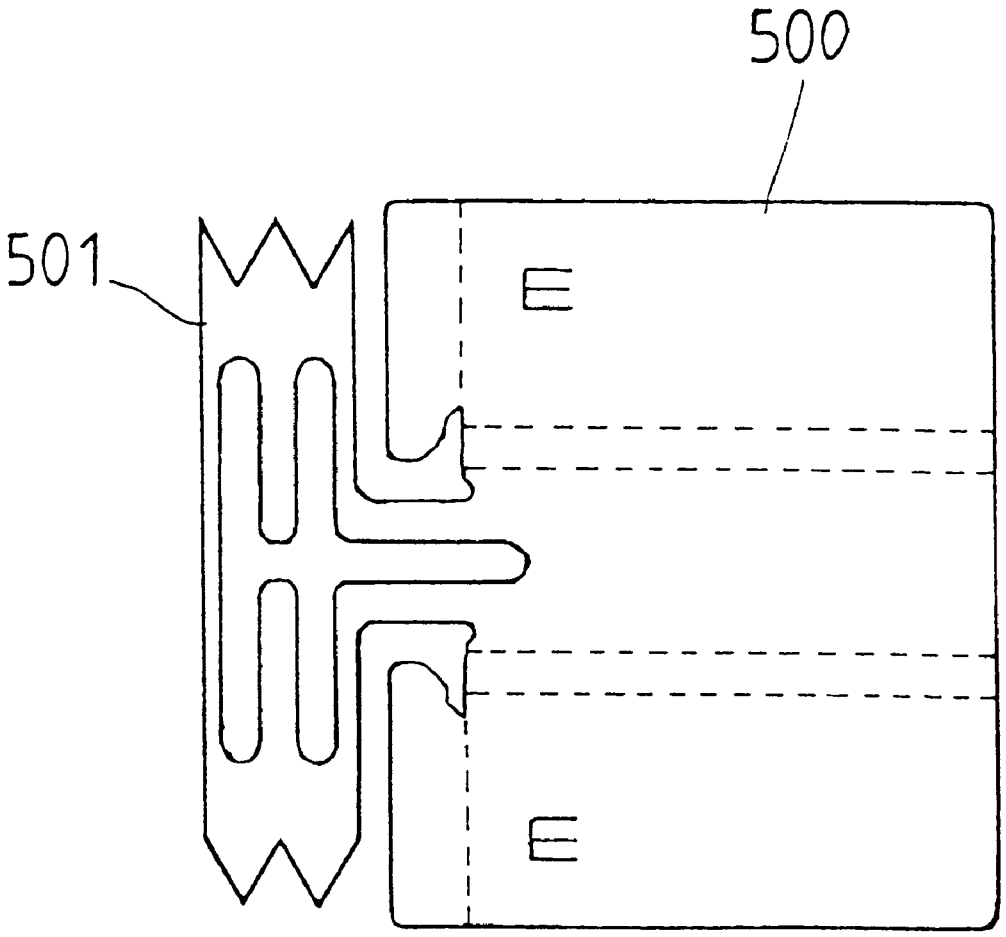
FIG. 12 shows the top of the connector casing of FIG. 10 in an unfolded state.

FIG. 10 is a perspective showing another embodiment of the connector casing of FIG. 6, FIGS. 11A and 11B show the forming of a top 500 for the connector casing of FIG. 10, and FIG. 12 is an unfolded plan view of the top 500 of FIG. 10. As shown in the drawings, the top 500 is provided at its cable end with a forward projected cable holder 501 and a baffle 502 behind and separate from the cable holder 501. When the baffle 502 is folded to a vertical position, an opening 503 is formed at a middle portion of the baffle 502 for the baffle 502 to fittingly straddle an outer periphery of the cable 200 and hold the cable 200 in place and close the cable end of the top 500.

Figure 13:
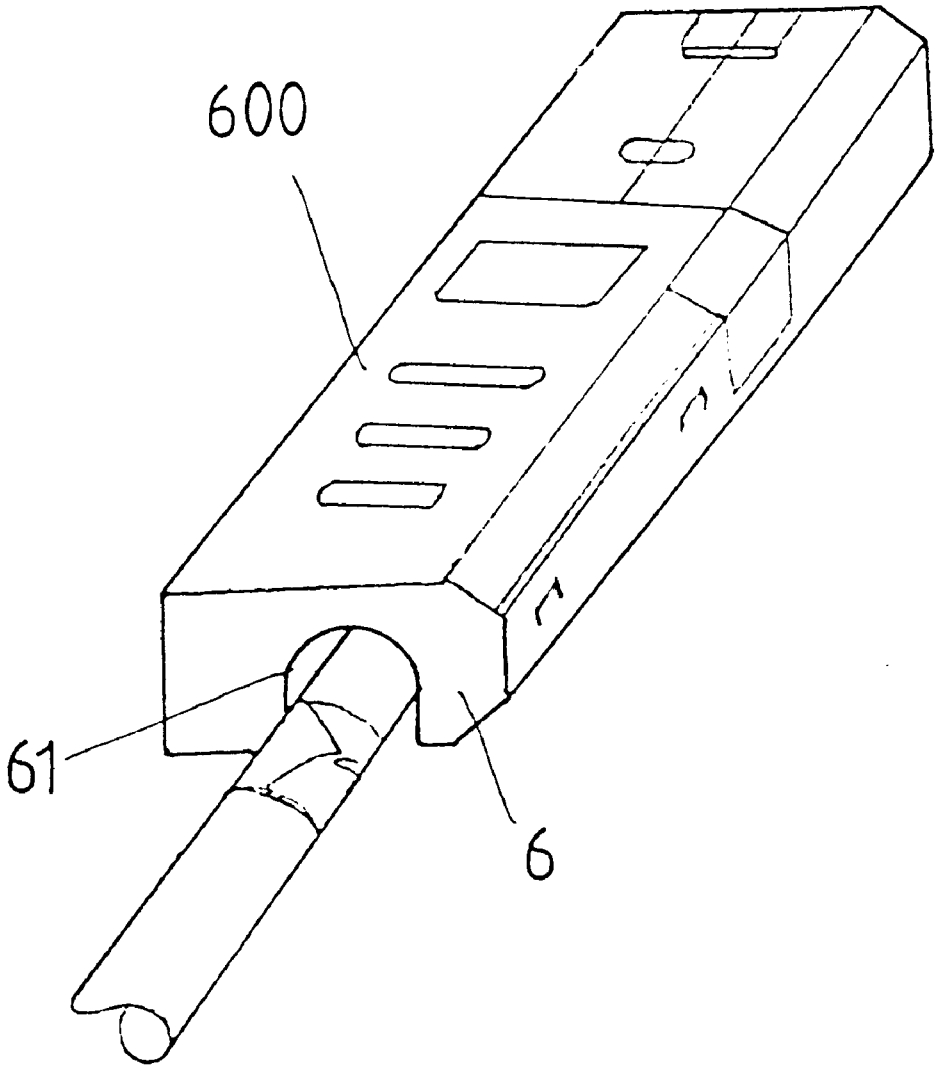
FIG. 13 is a perspective view showing a connector casing according to a third embodiment of the present invention.
Figure 14:
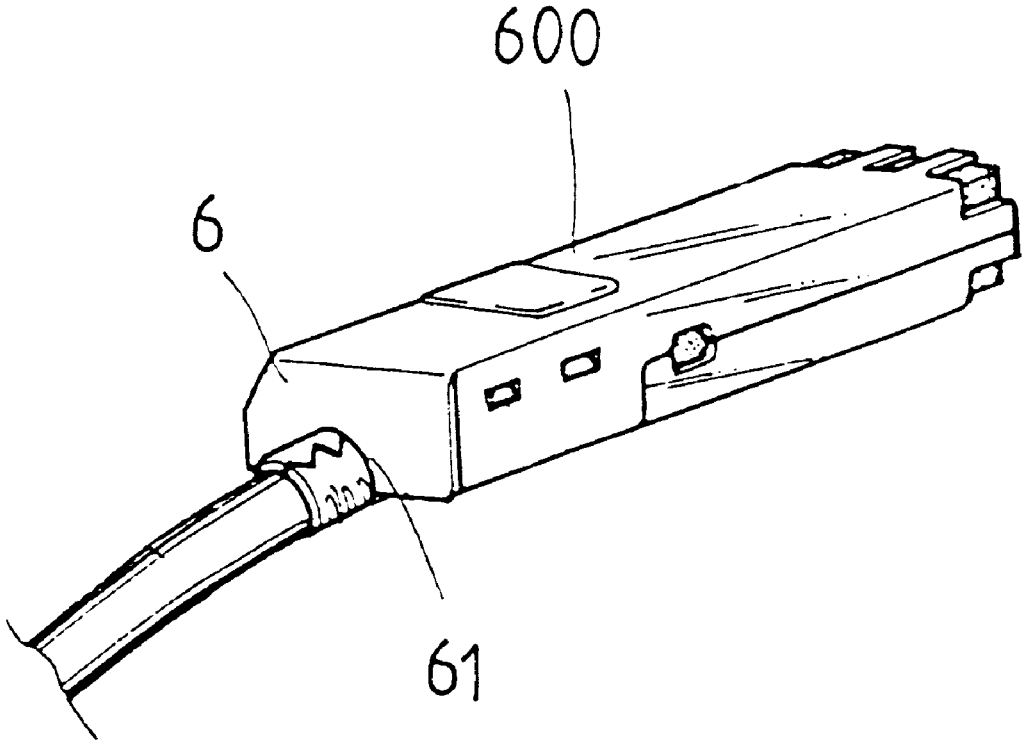
FIG. 14 is a perspective view showing a connector casing according to a fourth embodiment of the present invention; and, "FIG. 15 is a cross-section view taken along line XV—XV in FIG. 11A.".

FIG. 13 is a perspective showing an IEEE-1394 series long type connector adopting the connector casing of the present invention. FIG. 14 is a perspective showing a short type connector of FIG. 13. The connectors shown in FIGS. 13 and 14 both include a top 600 having a baffle 6 provided at a cable end thereof. The baffle 6 is formed with an opening 61 for fittingly straddling an outer periphery of a cable and thereby completely closes the cable end of the connector.

With the above arrangements, the baffle provided on the terminal case of the connector may effectively stop fluid plastics for forming the insulating cover of the connector from entering into the terminal case and damaging terminals and other components in the terminal case.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A connector casing forming an interior space with a cable extending into the interior space, and having a baffle to prevent fluid plastic from entering the connector casing during molding of an insulating cover, the connector casing comprising:

a) a base having opposite, upstanding base side walls, and a cable holder extending from one end of the base, b) a top attached to the base to form the interior space therebetween, the top having opposite, depending top side walls and a baffle depending from one end of the top in contact with ends of the opposite, depending top side walls, the baffle having an arcuate edge bounding an opening, the arcuate edge being in contact with the cable so as to prevent fluid plastics from entering the interior space during formation of an insulating cover around the connector, the depending top side walls overlapping the upstanding base side walls; and, c) fastening elements formed on the upstanding base side walls and the depending top side w alls to hold the top and base attached together.

2. The connector casing of claim 1, further comprising side panels extending from opposite sides of the baffle.

3. The connector casing of claim 1, wherein the baffle comprises first and second baffle portions attached to the top, each baffle portion having an arcuate edge portion forming a portion of the arcuate edge bounding the opening.

4. The connector casing of claim 3, wherein each baffle portion further comprises a side panel extending from an edge portion opposite from the arcuate edge portion.

5. The connector casing of claim 3, wherein the baffle portions each extend from one of the opposite, depending top sides.

* * * * *